US010317099B2

(12) United States Patent
Hirsch et al.

(10) Patent No.: US 10,317,099 B2
(45) Date of Patent: Jun. 11, 2019

(54) VARIABLE AIR VOLUME DIFFUSER AND METHOD OF OPERATION

(71) Applicant: Air Distribution Technologies IP, LLC, Milwaukee, WI (US)

(72) Inventors: Joachim Hirsch, Colleyville, TX (US); Gary A. Minor, Flower Mound, TX (US); Makavan Hayes, Richardson, TX (US)

(73) Assignee: Air Distribution Technologies IP, LLC, Milwaukee, WI (US)

( * ) Notice: Subject to any disclaimer, the term of this patent is extended or adjusted under 35 U.S.C. 154(b) by 626 days.

(21) Appl. No.: 14/688,988

(22) Filed: Apr. 16, 2015

(65) Prior Publication Data

US 2016/0305677 A1 Oct. 20, 2016

(51) Int. Cl.

| | |
|---|---|
| ***F24F 11/00*** | (2018.01) |
| ***F24F 13/10*** | (2006.01) |
| *F24F 5/00* | (2006.01) |
| *F24F 140/40* | (2018.01) |

(52) U.S. Cl.

CPC ..... *F24F 11/0001* (2013.01); *F24F 13/10* (2013.01); *F24F 2005/0067* (2013.01); *F24F 2140/40* (2018.01)

(58) Field of Classification Search

CPC ..... F24F 13/06; F24F 13/12; F24F 2013/1433
USPC ..... 454/248, 292, 300–303
See application file for complete search history.

(56) References Cited

U.S. PATENT DOCUMENTS

| | | | | |
|---|---|---|---|---|
| 3,070,346 | A * | 12/1962 | Kennedy | F24F 11/04 251/266 |
| 4,417,687 | A | 11/1983 | Grant | |
| 5,003,867 | A * | 4/1991 | Sodec | F24F 3/044 454/236 |
| 5,251,815 | A | 10/1993 | Foye | |
| 6,059,260 | A * | 5/2000 | Jacob | F16K 31/046 251/129.12 |
| 6,363,736 | B1 | 4/2002 | Kunkel et al. | |
| 6,431,127 | B2 | 8/2002 | Weber | |
| 7,667,376 | B2 | 2/2010 | Schmidt | |
| 7,692,411 | B2 | 4/2010 | Trainor et al. | |
| 7,781,943 | B1 | 8/2010 | Hamel et al. | |
| 7,830,072 | B2 | 11/2010 | Schmidt | |
| 7,864,507 | B2 | 1/2011 | Fleig et al. | |

(Continued)

FOREIGN PATENT DOCUMENTS

| | | | |
|---|---|---|---|
| JP | S54-41562 | A | 4/1979 |
| KR | 2015-0030879 | A | 3/2015 |

(Continued)

OTHER PUBLICATIONS

The International Search Report and Written opinion issued by European Patent Office dated Oct. 25, 2016 for PCT patent application No. PCT/US2016/028123.

(Continued)

*Primary Examiner* — Steven B McAllister
*Assistant Examiner* — Ko-Wei Lin
(74) *Attorney, Agent, or Firm* — Fletcher Yoder, P.C.

(57) ABSTRACT

A variable air volume diffuser and method of operation are disclosed. The system includes an energy harvesting device, a ring-shaped damper and a frame adapted to interface with the ring-shaped damper, wherein the ring-shaped damper is driven by energy harvested from the energy harvesting device.

19 Claims, 5 Drawing Sheets

100

(56) References Cited

U.S. PATENT DOCUMENTS

| | | | | |
|---|---|---|---|---|
| 7,884,727 | B2 | 2/2011 | Tran | |
| 7,982,439 | B2 | 7/2011 | Trainor et al. | |
| 8,086,352 | B1 | 12/2011 | Elliott | |
| 8,228,151 | B2 | 7/2012 | Schmidt | |
| 8,249,731 | B2 | 8/2012 | Tran et al. | |
| 8,350,519 | B2 | 1/2013 | Brantner et al. | |
| 8,531,047 | B2 | 9/2013 | Schmidt et al. | |
| 8,621,245 | B2 | 12/2013 | Sgearer et al. | |
| 9,197,143 | B1 | 11/2015 | Townsend et al. | |
| 9,680,324 | B2 | 6/2017 | Wiley et al. | |
| 2001/0025610 | A1 | 10/2001 | Weber | |
| 2004/0159713 | A1 | 8/2004 | Schmidt et al. | |
| 2005/0040782 | A1 | 2/2005 | Jasinski et al. | |
| 2005/0087616 | A1 | 4/2005 | Attridge | |
| 2005/0144963 | A1 | 7/2005 | Peterson et al. | |
| 2005/0227609 | A1* | 10/2005 | Koessler | F24F 13/062 454/300 |
| 2005/0258259 | A1 | 11/2005 | Stanimirovic | |
| 2005/0270151 | A1 | 12/2005 | Winick | |
| 2005/0278069 | A1 | 12/2005 | Bash et al. | |
| 2006/0281435 | A1 | 12/2006 | Shearer et al. | |
| 2007/0182362 | A1 | 8/2007 | Trainor et al. | |
| 2008/0083446 | A1 | 4/2008 | Chakraborty et al. | |
| 2009/0102296 | A1 | 4/2009 | Greene et al. | |
| 2009/0168305 | A1 | 7/2009 | Fleig et al. | |
| 2009/0251099 | A1 | 10/2009 | Brantner et al. | |
| 2010/0060231 | A1 | 3/2010 | Trainor et al. | |
| 2010/0090656 | A1 | 4/2010 | Shearer et al. | |
| 2010/0112925 | A1* | 5/2010 | Schmitt | H05K 7/1497 454/184 |
| 2010/0139306 | A1 | 6/2010 | Krenik | |
| 2010/0277270 | A1 | 11/2010 | Aikens et al. | |
| 2010/0315046 | A1 | 12/2010 | Trainor et al. | |
| 2011/0034120 | A1 | 2/2011 | Jaiyeola | |
| 2011/0077758 | A1 | 3/2011 | Tran et al. | |
| 2011/0109102 | A1 | 5/2011 | McCoy et al. | |
| 2011/0115222 | A1 | 5/2011 | Parker et al. | |
| 2011/0158806 | A1 | 6/2011 | Arms et al. | |
| 2011/0172828 | A1 | 7/2011 | Schmidt et al. | |
| 2011/0208450 | A1 | 8/2011 | Salka et al. | |
| 2012/0068669 | A1 | 3/2012 | Trainor et al. | |
| 2012/0072030 | A1 | 3/2012 | Elliott | |
| 2012/0256492 | A1 | 10/2012 | Song et al. | |
| 2013/0013120 | A1 | 1/2013 | Sabripour | |
| 2013/0024029 | A1 | 1/2013 | Tran et al. | |
| 2013/0181689 | A1 | 7/2013 | Ocalan | |
| 2013/0201316 | A1 | 8/2013 | Binder et al. | |
| 2013/0217294 | A1 | 8/2013 | Karunaratne | |
| 2013/0328416 | A1 | 12/2013 | Whitworth et al. | |
| 2014/0111032 | A1 | 4/2014 | Shearer et al. | |
| 2014/0222216 | A1 | 8/2014 | Chen | |
| 2014/0330438 | A1 | 11/2014 | Haines et al. | |
| 2016/0007525 | A1 | 1/2016 | Drew et al. | |
| 2017/0227251 | A1* | 8/2017 | Salomonsson | F24F 13/12 |

FOREIGN PATENT DOCUMENTS

| | | | |
|---|---|---|---|
| RU | 2538514 | C1 | 1/2015 |
| WO | 2014/018304 | A1 | 1/2014 |

OTHER PUBLICATIONS

The invitation to pay additional fees and, where applicable, protest fee mailed by European Patent Office dated Jul. 25, 2016 for PCT patent application No. PCT/US2016/028123.

* cited by examiner

VARIABLE AIR VOLUME DIFFUSER AND METHOD OF OPERATION

TECHNICAL FIELD

The present disclosure relates generally to heating, ventilation and air conditioning (HVAC) systems, and more specifically to a variable air volume (VAV) diffuser and method of operation.

BACKGROUND OF THE INVENTION

HVAC systems use dampers to control the flow of conditioned air into ducts, rooms and other structures.

SUMMARY OF THE INVENTION

A variable air volume diffuser and method of operation are disclosed. The system includes an energy harvesting device, a ring-shaped damper and a frame adapted to interface with the ring-shaped damper, wherein the ring-shaped damper is driven by energy harvested from the energy harvesting device.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE SEVERAL VIEWS OF THE DRAWINGS

Aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views, and in which.

DETAILED DESCRIPTION OF THE INVENTION

Figure 1:
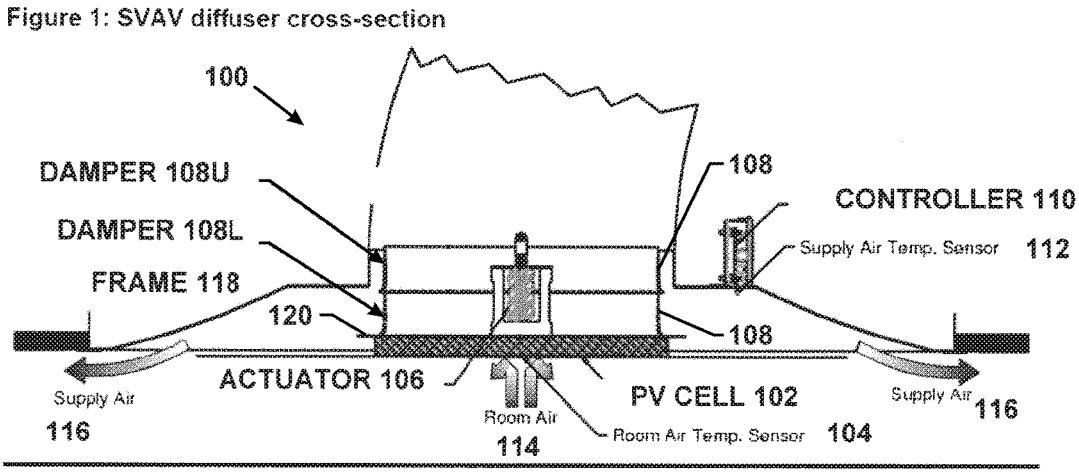
FIG. 1 is a diagram of a light-powered VAV diffuser in accordance with an exemplary embodiment of the present disclosure.

In the description that follows, like parts are marked throughout the specification and drawings with the same reference numerals. The drawing figures might not be to scale and certain components can be shown in generalized or schematic form and identified by commercial designations in the interest of clarity and conciseness.

FIG. 1 is a diagram of a light-powered VAV diffuser 100 in accordance with an exemplary embodiment of the present disclosure. Light-powered VAV diffuser 100 is an energy harvesting self-contained variable air volume (VAV) diffuser and zone control system. Photovoltaic (PV) cells 102 are used to generate the electricity to operate all electrical and electronic devices mounted to the diffuser. Electrical power is stored at an energy level that is suitable to drive an electrical control system as well as an electric actuator motor 106 and at least one sensor, such as supply air temperature sensor 112 or room air temperature sensor 114. The electric actuator motor 106 opens or closes a VAV salve formed by damper 108 and frame 118 in the prime air inlet of the diffuser. The supply air 116 temperature and room air 114 temperature are measured and the measurement results are sent to controller 110. The room temperature set point is adjustable and can be displayed at a room thermostat (not shown). Controller 110 is configured to wake up periodically and run a control sequence to determine if the actuator needs to adjust the air flow to the room.

Light-powered VAV diffusers 100 can be used as part of a building HVAC system. A single duct terminal unit can provide conditioned supply air 116 from the air handler to each zone. Each light-powered VAV diffuser 100 in the zone can be used to regulate or control the flow of conditioned air to the zone.

When the unit is supplied with conditioned (heated or cooled) air, the supply air temperature sensor 112 and the room air temperature sensor 104 will provide controller 110 with a temperature reading. Controller 110 can transmit the readings to a central controller for processing and receipt of set points, or can use preselected or user-entered set points to determine whether to change the position of damper 108. Deviations from the set point can be used to generate control signals for electric actuator motor 106. Electric actuator motor 106 then opens or closes the VAV control valve in response to the control signals, in order to maintain comfort in the space. The room temperature can also or alternatively be monitored by either a room thermostat or the integrated diffuser temperature sensors to generate a signal to the controller 110 representing an amount of heating or cooling required for comfort control. Algorithms can also or alternatively be used if a wall thermostat is not used, to calculate the room temperature in the occupied space. If air flow volume is required, controller 110 can respond at its next control cycle and damper 108 can then be adjusted.

Controller 110 has a network address or other suitable addressing functionality that can be used for receiving external, computer-controlled commands. These commands can be used to set minimum air flows, such as with drive damper 108 full open (108U), full closed (108L) or at any suitable location in-between, where the damper plate 120 forms an air-tight barrier against the flow of conditioned supply air 116 into the room when damper 108 is in the full closed position (108L). A suitable number of diffusers can be controlled using a centralized controller. An electric reheat coil option (such as when used with an external power supply that is not light-powered) can also be installed in the inlet of a diffuser and controlled by controller 110. This configuration can be used to allow the system to provide cooling to each zone but also to provide heating in a zone in which heating is required.

Light-powered VAV diffuser 100 does not require external electrical power, and can generate its own electrical power using photovoltaic cells 102 on the face of the diffuser. An electric motor actuator 106 is located in the diffuser inlet and drives an air flow damper 108 open and closed. Controller 110 can receive high frequency radio signals from a thermostat, a central controller, sensors 104, 112 or other suitable devices or systems. Light-powered VAV diffuser 100 thus does not need any kind of wiring, signal wire or power wire in these configurations, and can maintain comfort/temperature control of a room or zone without any physical connections to a building wiring. This configuration saves installation time, saves the cost for providing wiring to the building, and allows for an easy change of use in a building, as no rewiring of thermostats or diffuser power lines are required. This configuration also helps to simplify the planning of a building air distribution system.

Controller 110 can be implemented in hardware or a suitable combination of hardware and software, and can be one or more algorithms operating on a special purpose processor. As used herein, "hardware" can include a combination of discrete components, an integrated circuit, an application-specific integrated circuit, a field programmable gate array, or other suitable hardware. As used herein, "software" can include one or more objects, agents, threads, lines of code, subroutines, separate software applications, two or more lines of code or other suitable software structures operating in two or more software applications, on one or more processors (where a processor includes a microcomputer or other suitable controller, memory devices, input-output devices, displays, data input devices such as a keyboard or a mouse, peripherals such as printers and speakers, associated drivers, control cards, power sources, network devices, docking station devices, or other suitable devices operating under control of software systems in conjunction with the processor or other devices), or other suitable software structures. In one exemplary embodiment, software can include one or more lines of code or other suitable software structures operating in a general purpose software application, such as an operating system, and one or more lines of code or other suitable software structures operating in a specific purpose software application. As used herein, the term "couple" and its cognate terms, such as "couples" and "coupled," can include a physical connection (such as a copper conductor), a virtual connection (such as through randomly assigned memory locations of a data memory device), a logical connection (such as through logical gates of a semiconducting device), other suitable connections, or a suitable combination of such connections.

Figure 2:
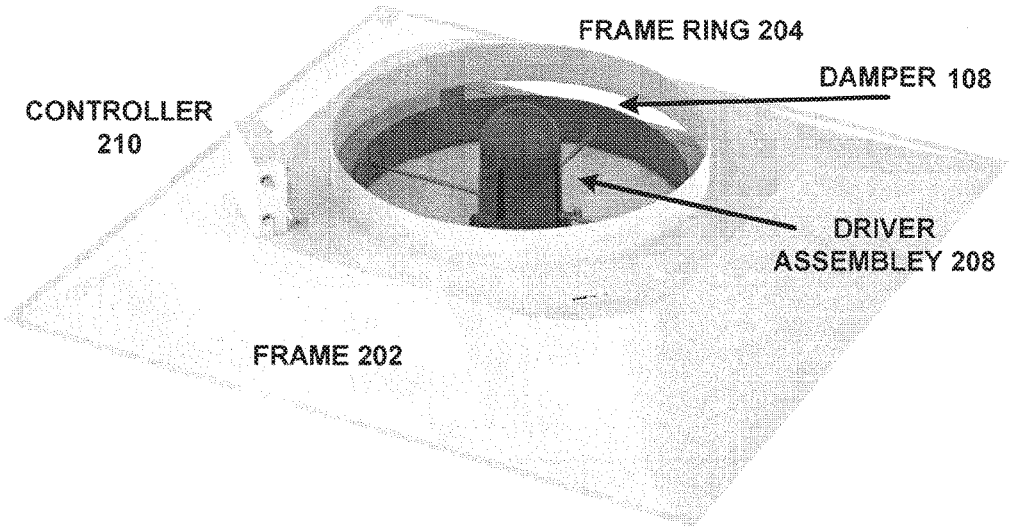
FIG. 2 is a diagram showing a configuration for a light-powered VAV diffuser, in accordance with an exemplary embodiment of the present disclosure.

FIG. 2 is a diagram 200 showing a configuration for a light-powered VAV diffuser, in accordance with an exemplary embodiment of the present disclosure. Diagram 200 includes frame 202 with frame ring 204, which encircles the damper 108 when driver assembly 208 has fully closed driver assembly with frame 202. Controller 210 is disposed outside of frame ring 204, adjacent to the supply air ductwork.

Figure 3:
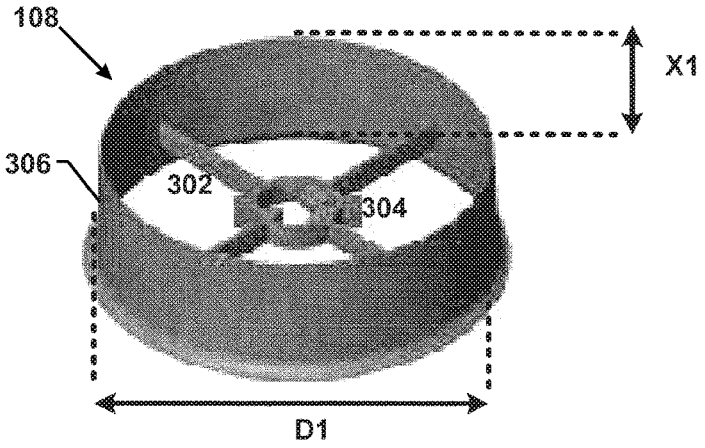
FIG. 3 is a diagram showing a damper configuration in accordance with an exemplary embodiment of the present disclosure.

FIG. 3 is a diagram 300 showing a damper configuration in accordance with an exemplary embodiment of the present disclosure. Diagram 300 includes the damper 108 having a damper ring wall 306 with height X1, as indicated by the arrow, and with a relatively smaller damper diameter D1, as indicated by the arrow. A cross-brace assembly 302 supports center ring 304, which holds actuator 106.

Figure 4:
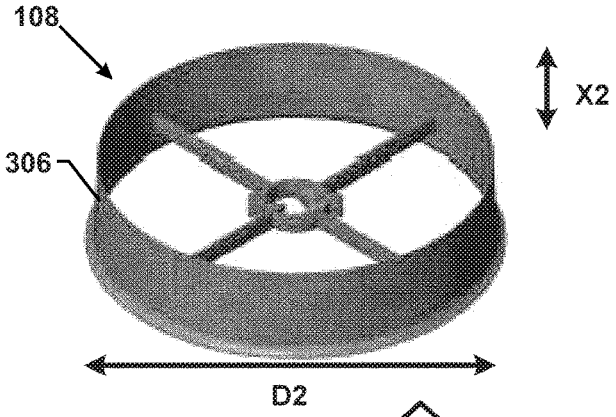
FIG. 4 is a diagram showing a damper configuration in accordance with an exemplary embodiment of the present disclosure.

FIG. 4 is a diagram 400 showing a damper configuration in accordance with an exemplary embodiment of the present disclosure. Diagram 400 includes the damper 108, in which the damper ring wall 306 has a height X2, with a relatively middle-sized damper diameter D2.

Figure 5:
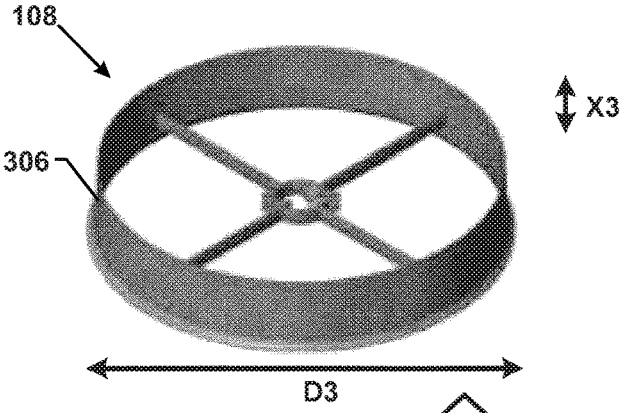
FIG. 5 is a diagram showing a damper configuration in accordance with an exemplary embodiment of the present disclosure.

FIG. 5 is a diagram 500 showing a damper configuration in accordance with an exemplary embodiment of the present disclosure. Diagram 500 includes the damper 108, in which the damper ring wall 306 has a height X3, with a relatively larger damper diameter D3.

Figure 6:
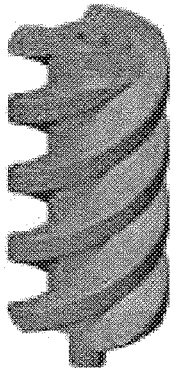
FIG. 6 is a diagram of a drive shaft in accordance with an exemplary embodiment of the present disclosure.

FIG. 6 is a diagram of a drive shaft 600 in accordance with an exemplary embodiment of the present disclosure. Drive shaft 600 is a screw-shaped drive shaft that is coupled to a drive motor, and which provides a reduced-torque drive suitable for low-power applications, such as for actuator 106 or other suitable devices. When drive shaft 600 rotates, the damper 108 in which drive shaft 600 is disposed is moved towards or away from the drive motor, depending on the direction of rotation.

Figure 7:
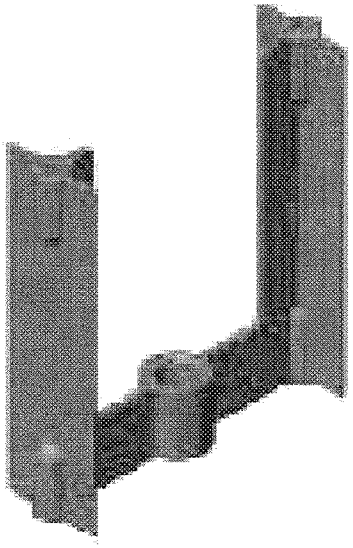
FIG. 7 is a diagram of a drive shaft frame in accordance with an exemplary embodiment of the present disclosure.

FIG. 7 is a diagram of a drive shaft frame 700 in accordance with an exemplary embodiment of the present disclosure. Drive shaft frame 700 holds drive shaft 600, which displaces the damper 108 and associated damper plate 120, such as for actuator 106 or other suitable devices. Drive shaft frame 700 is coupled to a suitable support structure, to allow torque that is developed by the rotation of drive shaft 600 to be converted into a force that displaces the damper plate 120 towards or away from the support structure.

Figure 8:
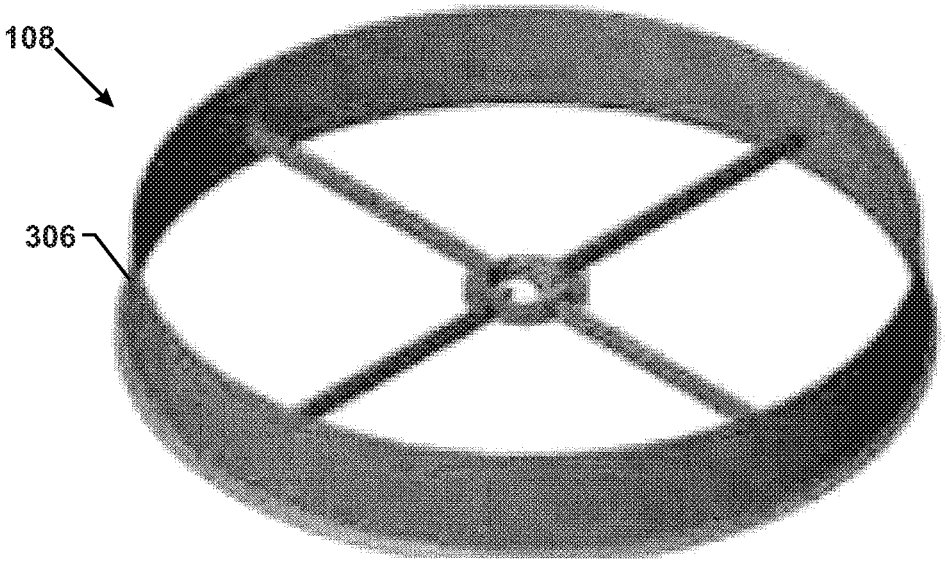
FIG. 8 is a diagram showing a damper configuration in accordance with an exemplary embodiment of the present disclosure.

FIG. 8 is a diagram 800 showing a damper configuration in accordance with an exemplary embodiment of the present disclosure. Diagram 800 includes the damper 180 having a relatively small damper ring wall 306 with a relatively large damper diameter.

Figure 9:
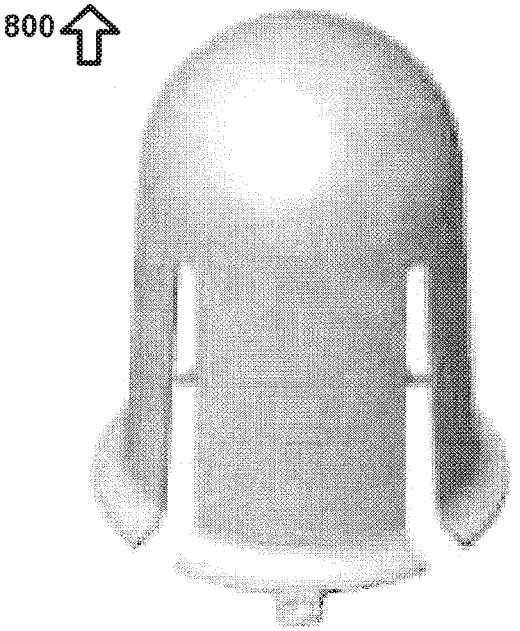
FIG. 9 is a diagram showing a drive shaft housing in accordance with an exemplary embodiment of the present disclosure.

FIG. 9 is a diagram 900 showing a drive shaft housing in accordance with an exemplary embodiment of the present disclosure. Diagram 900 includes a dome-shaped housing that encloses drive shaft 600 and drive shaft frame 700.

Figure 10:
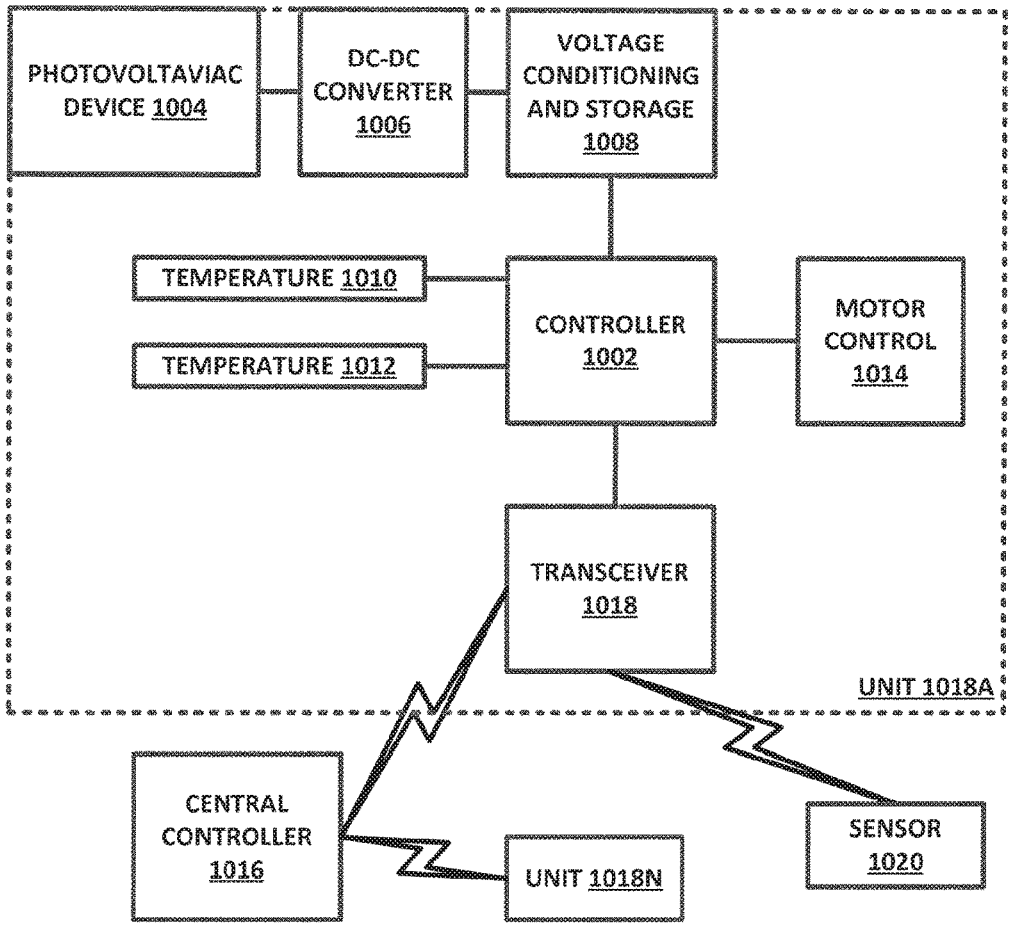
FIG. 10 is a diagram of a system for energy harvesting damper control, in accordance with an exemplary embodiment of the present disclosure.

FIG. 10 is a diagram of a system 1000 for an energy harvesting damper control, in accordance with an exemplary embodiment of the present disclosure. System 1000 includes controller 1002, photovoltaic device 1004, DC to DC converter 1006, voltage conditioning and storage 1008, temperature sensor 1010, temperature sensor 1012, motor control 1014, transceiver 1018 and central controller 1016, which can be implemented in hardware or in suitable combination of hardware and software.

Controller 1002 can be a suitable controller for use with energy harvesting applications, such as an STM 300 energy harvesting wireless sensor module, available from Enocean of Munich, Germany, or other suitable controllers. Controller 1002 is coupled to voltage conditioning and storage 1008, temperature sensor 1010, temperature sensor 1012, motor control 1014 and transceiver 1018, and coordinates system operation of these and other suitable components of system 1000. Controller 1002 can be used to control a position of a damper or other suitable HVAC or building management equipment, without the need for power, control or instrumentation cabling. A plurality of controllers 1002 can be disposed around the building and the HVAC system, to provide wireless control of building energy consumption and HVAC settings.

Photovoltaic device 1004 generates electrical energy as a function of ambient light. In one exemplary embodiment, photovoltaic device 1004 can be configured to generate electrical energy if the ambient light is adequate for normal office operations. Likewise, other suitable devices can also or alternatively be used instead of photovoltaic device 1004, such as a Peltier device, Seebeck effect device, a Thompson effect device, a microturbine or other suitable devices.

DC to DC converter 1006 receives direct current electrical energy at a low voltage, such as 20 mV, and converts the voltage to a higher voltage, such as 3 to 4 Volts. In one exemplary embodiment, the output of DC to DC converter 1006 can be selected to prevent damage to an energy storage capacitor, controller 1002 and other devices, such as due to overvoltage, undervoltage or other conditions. In this exemplary embodiment, if the energy storage capacitor is a 40 Farad capacitor with a rated operating voltage of 3.8 volts, then a design voltage output for DC to DC converter 1006 can be selected to be no greater than 3.8 volts.

Voltage conditioning and storage 1008 provides overvoltage and undervoltage protection for the components of system 100, provides energy storage and performs other suitable functions. In one exemplary embodiment, if the energy storage capacitor is a 40 Farad capacitor with a rated operating voltage of 3.8 volts, then the overvoltage protection for the energy storage capacitor can be set to limit the charging voltage to a lower level, such as 3.6 volts. Likewise, the undervoltage protection can be set to prevent discharging the energy storage capacitor to less than 2.2 volts, such as to prevent damage to the energy storage capacitor, and other suitable protection can be provided.

Temperature sensor 1010 is used to measure the temperature of the air contained with an HVAC duct and to perform other suitable temperature measurements. In one exemplary embodiment, temperature sensor 110 can be a resistive temperature detector (RTD), a thermistor, a thermocouple, other suitable devices, a combination of devices, an array of devices or other suitable temperature sensing devices or arrangements.

Temperature sensor 1012 is used to measure the ambient air temperature and to perform other suitable temperature measurements. In one exemplary embodiment, temperature sensor 1012 can be a resistive temperature detector (RTD), a thermistor, a thermocouple, other suitable devices, a combination of devices, an array of devices or other suitable temperature sensing devices or arrangements.

Motor control 1014 is used to control a motor for adjusting the position of a damper, such as to open or close the damper, to determine the position of the damper and for other suitable purposes. In one exemplary embodiment, motor control 114 can include motor current sensors, motor voltage sensors, motor position sensors, motor actuators and other suitable devices.

Central controller 1016 communicates with a large number of controllers 1002 and its associated components, which each form a unit 1018A through 1018N, and which are each installed at locations where a controllable damper is located in the HVAC system for a building. In this manner, central control 116 can receive temperature and pressure data from each of the plurality of controllers, as well as temperature data associated with each of a plurality of rooms, hallways or other building structures that receive conditioned air from the HVAC system, and can determine whether a damper position needs to be changed to increase or decrease a temperature in a room, hallway or other building location, to increase or reduce a flow of conditioned air based on scheduled occupancy estimates, or to otherwise control the flow of conditioned air.

Transceiver 1018 sends wireless data from controller 102 to central controller 1016 and receives wireless data from central controller 1016 for controller 1002. In one exemplary embodiment, central controller 1016 can periodically transmit data to transceiver 1018 that causes controller 1002 to transition from a low power state to a high power state, to read a temperature measurement from temperature sensor 1012, to read a temperature measurement from temperature sensor 1010, to transmit the pressure and temperature data to central controller 1016, to receive damper configuration data from central controller 1016, to change a position of a damper associated with motor control 1014, and to perform other suitable functions. Transceiver 1018 can also or alternatively interact with sensor 1020, which can include a carbon dioxide sensor, a window opening sensor or other suitable sensors that can be used to provide control data to controller 1002, so as to allow controller 1002 to open or close a damper if carbon dioxide levels are too high, if a window is opened or closed or in other suitable manners.

In operation, system 1000 allows damper settings and other settings of an HVAC system to be remotely controlled, and uses photovoltaic energy recovery or other suitable energy recovery to provide power for the dampers or other HVAC equipment. System 100 thus eliminates the need for running electrical power, signaling and control cabling to distributed points of a building or HVAC system, by utilizing local electric power generation and storage.

Figure 11:
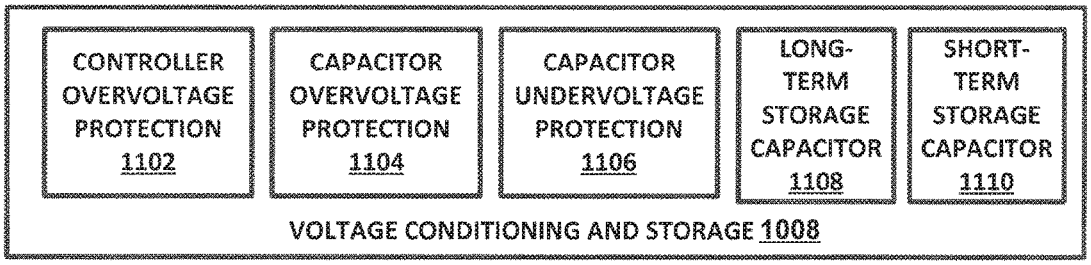
FIG. 11 is a diagram of a system for voltage conditioning and storage, in accordance with an exemplary embodiment of the present disclosure.

FIG. 11 is a diagram of a system 1100 for voltage conditioning and storage, in accordance with an exemplary embodiment of the present disclosure. System 1100 includes controller overvoltage protection 1102, capacitor overvoltage protection 1104, capacitor undervoltage protection 1106, long term storage capacitor 1108 and short term storage capacitor 1110, each of which can be implemented in hardware or a suitable combination of hardware and software (other than discrete components).

Controller overvoltage protection 1102 provides overvoltage protection for a controller, such as an STM 300 energy harvesting wireless sensor module, available from Enocean of Munich, Germany, or other suitable controllers. In one exemplary embodiment, controller overvoltage protection 1102 can limit the voltage provided to the controller to a maximum of 4.2 volts, such as by using a 10 microfarad capacitor in parallel with the controller to monitor the voltage that is being applied to the controller, and by isolating the controller from the voltage source (such as DC to DC converter 1006 or other suitable voltage sources) if the voltage exceeds the maximum voltage, or in other suitable manners.

Capacitor overvoltage protection 1104 provides overvoltage protection for an energy storage capacitor, such as a 40 Farad capacitor with a rated operating voltage of 3.8 volts. In this exemplary embodiment, a 100 nanofarad capacitor in parallel with the energy storage capacitor can be used to monitor the voltage that is being applied to the energy storage capacitor, and by isolating the capacitor from the voltage source (such as DC to DC converter 1006 or other suitable voltage sources) if the voltage exceeds the maximum voltage, or in other suitable manners.

Capacitor undervoltage protection 1106 provides undervoltage protection for an energy storage capacitor, such as a 40 Farad capacitor with a rated operating voltage of 3.8 volts. In this exemplary embodiment, a 100 nanofarad capacitor connected between a base and a collector of a bipolar junction transistor or other suitable devices can be used to turn off a switch between the energy storage capacitor and the load (such as controller 1002 or other suitable loads) if the voltage falls below the minimum voltage, or in other suitable manners.

Long term storage capacitor 1108 is used to store electrical energy that is recovered or harvested from a local device, such as a photovoltaic device, Peltier effect device, a Seebeck effect device, a Thompson effect device, a micro turbine or other suitable devices. In one exemplary embodiment, long term storage capacitor 1108 can be a 40 Farad capacitor with a rated operating voltage of 3.8 volts, or other suitable storage capacitors.

Short term storage capacitor 1110 is used to provide energy to controller 1002 or other loads when the voltage of long term storage capacitor 1108 is lower than an allowable threshold. In one exemplary embodiment, short term storage capacitor 1110 can be used to allow for faster recharging when long term storage capacitor 1108 is discharged but when controller 1002 is in operation, such as during an operational period between ten minute quiescent periods. For example, controller 1002 can transition from a quiescent period to an active period to measure a pressure and temperature reading, to transmit the pressure and temperature reading to a central controller, to receive a new damper position from the central controller and to actuate a motor to move the damper to the new damper position, during which time long term storage capacitor 1108 is discharged. If the charging rate of long term storage capacitor 1108 is too slow to allow it to be recharged sufficiently to complete the damper positioning, short term storage capacitor 1110 can be used instead, to allow a sufficient charge to be stored to complete the damper positioning and to allow controller 1002 to transition to the quiescent state.

In operation, system 1100 allows energy from a local environmental energy source to be used to charge a storage capacitor and to power a controller, for remote monitoring of temperature and pressure and remote operation of a motor controller. System 1100 provides over- and under-voltage protection to energy storage capacitors, controllers, and other suitable devices.

Figure 12:
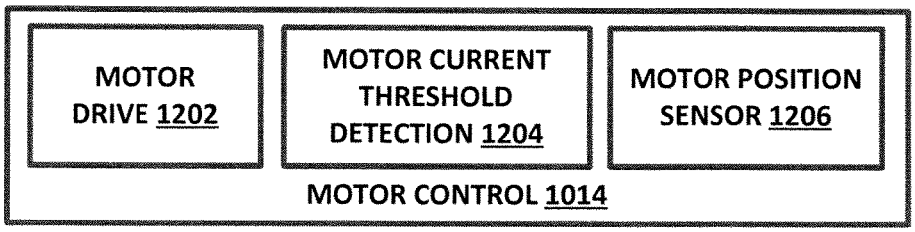
FIG. 12 is a diagram of a system for motor control, in accordance with an exemplary embodiment of the present disclosure.

FIG. 12 is a diagram of a system 1200 for motor control, in accordance with an exemplary embodiment of the present disclosure. System 1200 includes motor drive 1202, motor current threshold detection 1202 and motor position sensor 1206, each of which can be implemented in hardware or a suitable combination of hardware and software.

Motor drive 1202 receives voltage and current from a controller and actuates a motor, such as a stepper motor, a DC motor or other suitable motors. In one exemplary embodiment, the amount of current required to cause the motor to increment a single step can be provided, such as to cause a damper attached to the motor to open or close by a predetermined amount.

Motor current threshold detection 1202 receives motor current measurement data and determines whether the motor current measurement data exceeds a predetermined threshold. In one exemplary embodiment, if a damper connected to the motor reaches the fully open or fully closed position, such that it can no longer move in a given direction, continued application of torque from the motor can result in an increase in current drawn by the motor, such that the position of the damper can be determined by such excessive currents. If it is determined that the motor current has exceeded the threshold, then the direction of rotation of the motor and motor position data can be used to index the position as fully open or fully closed, as suitable.

Motor position sensor 1206 receives sensor data, such as from a Hall sensor attached to a motor shaft or in other suitable manners, and generates motor position tracking data. In one exemplary embodiment, a damper attached to a motor may have a predetermined number of positions between a fully open position and a fully closed position, such that motor position sensor 1206 can track the damper position by measuring and storing the number of steps taken from the fully open position towards the fully closed position, from the fully closed position towards the fully open position, the number of Hall sensor movements, or in other suitable manners.

Figure 13:
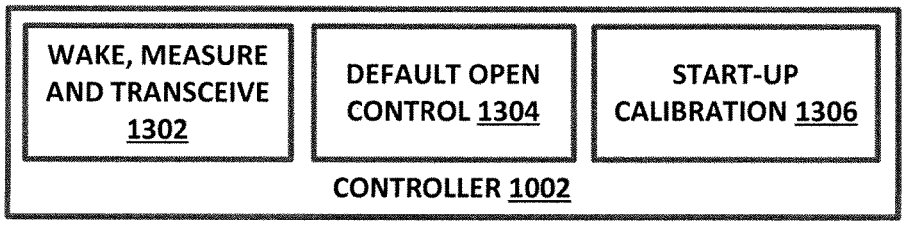
FIG. 13 is a diagram of a system for station control, in accordance with an exemplary embodiment of the present disclosure.

FIG. 13 is a diagram of a system 1300 for station control, in accordance with an exemplary embodiment of the present disclosure. System 1300 includes controller 1002 and wake, measure and transceive system 1302, default open control 1304 and start-up calibration control 1306, each of which can be implemented in hardware or a suitable combination of hardware and software.

Wake, measure and transceive system 1302 causes controller 1002 to activate from a low power state, to measure data from pressure sensors, temperature sensors and other suitable sensors, and to transmit the measured data to a central controller. Controller 1002 then waits for a wireless confirmation data message from the central controller before re-entering the low power mode. In one exemplary embodiment, the wireless confirmation data message can include instructions to move a stepper motor associated with a damper by a predetermined number of steps, to move a DC motor by a predetermined number of Hall sensor measurement increments or to otherwise move a motor associated with a damper, such as to incrementally open or close the damper to adjust a flow of conditioned air through a duct or other structure. In one exemplary embodiment, wake, measure and transceive system 1302 can receive a message from a central controller that causes wake, measure and transceive system 402 to activate controller 1002, wake, measure and transceive system 402 can include one or more independent timer circuits, or other suitable processes can also or alternatively be used.

Default open control 1304 monitors data communications received from a central controller and determines whether data is being received from the central controller. If no data is being received, then default open control 1304 causes an associated damper to open. In one exemplary embodiment, default open control 1304 can also cause the damper to open if the amount of stored energy remaining in a storage capacitor reaches a minimum level, or can perform other suitable functions.

Start-up calibration control 1306 causes controller 1002 to generate motor control commands to actuate a stepper motor or other suitable motors to move an associated damper through a range of motion, such as to determine a fully open position, a fully closed position, a number of Hall sensor measurements between the fully open and fully closed position, a number of motor steps between a fully open and a fully closed position, and other suitable data. In one exemplary embodiment, start-up calibration control 1306 can be activated when a controller 1002 is first powered up, after a service is performed or in other suitable manners.

Figure 14:
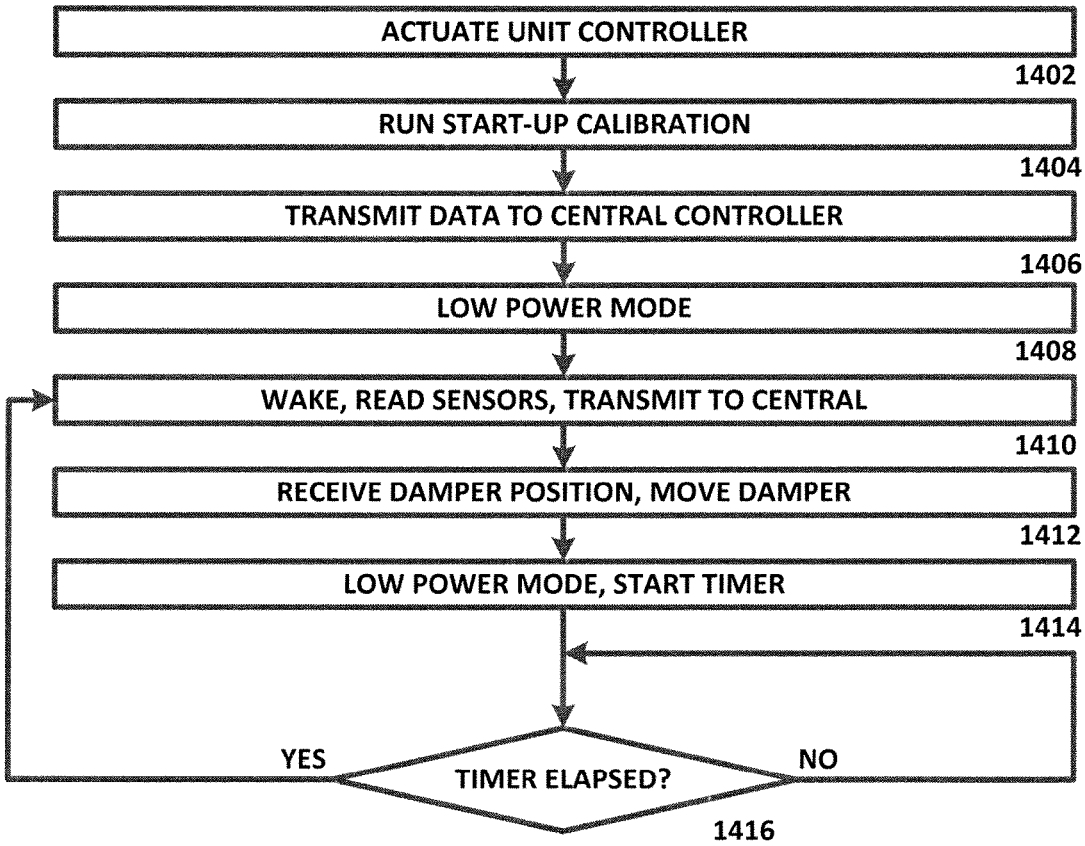
FIG. 14 is a diagram of an algorithm for station control, in accordance with an exemplary embodiment of the present disclosure.

FIG. 14 is a diagram of an algorithm 1400 for station control, in accordance with an exemplary embodiment of the present disclosure. Algorithm 1400 can be implemented in hardware or a suitable combination of hardware and software, and can be one or more algorithms operating on an STM 300 controller or other suitable controllers.

Algorithm 1400 begins at 1402, where a unit controller is actuated. In one exemplary embodiment, the unit controller can be turned on by an installer, and a message can be transmitted from the unit controller to determine whether a central controller is available. The algorithm then proceeds to 1404.

At 1404, a start-up calibration process is implemented. In one exemplary embodiment, the start-up calibration process can cause a motor associated with the unit controller to move in a first direction, such as an opening direction, until a current increase is measured that indicates that a damper associated with the motor has reached a first position, such as a fully open position. The start-up calibration process can then cause the motor to move in the opposite direction, until a current increase is measured that indicates that a damper associated with the motor has reached a second position, such as a fully closed position. Associated data, such as a number of stepper motor steps, a number of Hall effect sensor measurements or other suitable data can also be measured, stored or otherwise processed. The algorithm then proceeds to 1406.

At 1406, the measured data is transmitted to a central controller. In one exemplary embodiment, the unit controller can listen for messages from the central controller and can transmit a responsive message, the unit controller can transmit an "I am here" message and the central controller can send an acknowledgment message in response, or other suitable wireless data transmission protocols can be used. After communications between the unit controller and the central controller have been established, the unit controller transmits sensor data (such as temperature sensor data and pressure sensor data), damper position data and other suitable data, and the algorithm proceeds to 1408.

At 1408, the unit controller enters a low power mode, such as by shutting off power to all systems other than a system that is used to operate a timer, a system that is used to listen for wireless data messages or other suitable systems. In addition, the timer can be activated or other suitable processes can also or alternatively be performed. The algorithm then proceeds to 1410.

At 1410, the unit controller transitions from low power to high power mode, reads sensor data and transmits the sensor data to a central controller. In one exemplary embodiment, the unit controller can have a local timer mechanism that is used to determine a suitable low power mode period, such as 10 minutes, after which the unit controller transition is activated. In another exemplary embodiment, a transceiver can listen for a message from the central controller to activate the transition from low power mode to high power mode, or other suitable processes can also or alternatively be used. The algorithm then proceeds to 1412.

At 1412, damper position data is received at the unit controller from the central controller, and the unit controller causes a motor to activate so as to move the damper to a new position, if needed. In one exemplary embodiment, the central controller can receive damper position data, temperature data, pressure data and other suitable data from points along ductwork throughout an HVAC system, chiller or heater load data, room temperature and thermostat setting data or other suitable data, and can determine whether a damper position for a damper associated with the unit controller should be changed, such as to increase or decrease an amount of conditioned air that is available to rooms downstream from the damper, to reduce conditioned air flow to rooms that are not occupied or for other suitable purposes. The algorithm then proceeds to 1414.

At 1414, the unit controller transitions back to low power mode, and a timer is actuated. In one exemplary embodiment, the timer can be a local time, a timer at a central controller or other suitable timers. In addition, other suitable processes can also or alternatively be implemented to transition from a high power mode to a low power mode. The algorithm then proceeds to 1416.

At 1416, it is determined whether a predetermined period of time has elapsed. In one exemplary embodiment, a value from a local timer can be compared with a value stored in memory to determine whether the current time is past the stored time. Likewise, a central timer can be used to determine whether an activation data message should be transmitted to the unit controller, or other suitable processes can also or alternatively be used. If it is determined that the predetermined period of time has not elapsed, the algorithm returns to 1416, otherwise the algorithm returns to 1410.

In operation, algorithm 1400 allows a unit controller to transition between a high power mode and a low power mode in order to conserve energy, such as where the controller is powered from a local energy capture device. Algorithm 1400 allows the time between high power operation periods to be selected as a function of the amount of time required to recharge a storage capacitor or other devices, such as to ensure that sufficient energy is available to operate a motor control for a damper and to perform other operations. Although algorithm 1400 is shown as a flow chart, a state diagram, object oriented programming techniques or other suitable processes can also or alternatively be used.

It should be emphasized that the above-described embodiments are merely examples of possible implementations. Many variations and modifications may be made to the above-described embodiments without departing from the principles of the present disclosure. All such modifications and variations are intended to be included herein within the scope of this disclosure and protected by the following claims.

What is claimed is:

1. A system for controlling a ring-shaped damper, comprising:

an energy harvesting device;

the ring-shaped damper, wherein the ring-shaped damper comprises an outer damper wall that defines a central flow path through the ring-shaped damper and a plate coupled to the outer damper wall; and a frame adapted to interface with the ring-shaped damper, wherein the plate is configured to form an air-tight barrier with a portion of the frame extending around a circumference of the ring-shaped damper to block air flow through the central flow path when the ring-shaped damper is in a closed position, and wherein the ring-shaped damper is driven by energy harvested from the energy harvesting device.

2. The system of claim 1, further comprising a voltage conditioning and storage unit coupled to the energy harvesting device, wherein the voltage conditioning and storage unit is configured to apply overvoltage and undervoltage protection to a storage capacitor.

3. The system of claim 2, further comprising a controller coupled to the voltage conditioning and storage unit, wherein the voltage conditioning and storage unit is configured to apply overvoltage protection to the controller.

4. The system of claim 3, further comprising a motor control coupled to the controller, wherein the motor control is configured to actuate a driver that moves the ring-shaped damper to a fully open position if an amount of energy remaining in the storage capacitor reaches a predetermined amount.

5. The system of claim 1, wherein the outer damper wall has a height X.

6. The system of claim 1, wherein the outer damper wall has a diameter D.

7. The system of claim 1, wherein the ring-shaped damper further comprises a cross-brace support.

8. The system of claim 1, wherein the ring-shaped damper further comprises:

a central support ring; and a cross-brace support coupled the central support ring and the outer damper wall.

9. The system of claim 1, wherein the ring-shaped damper further comprises a driver coupled to the ring-shaped damper and the frame, wherein the driver is configured to move the ring-shaped damper away from the frame in a first direction and to move the ring-shaped damper toward the frame in a second direction.

10. The system of claim 9, wherein the driver further comprises a screw-shaped drive shaft.

11. The system of claim 1, wherein the frame further comprises one or more air vents.

12. The system of claim 1, further comprising a room air temperature sensor disposed on the frame.

13. The system of claim 1, further comprising a room air temperature sensor disposed on the ring-shaped damper.

14. The system of claim 1, further comprising one or more air vents disposed between the frame and the ring-shaped damper.

15. The system of claim 1, wherein the frame comprises a rectangular outer diameter.

16. The system of claim 1, wherein the frame is configured to attach to a ceiling.

17. The system of claim 1, further comprising a supply air temperature sensor coupled to the frame.

18. The system of claim 1, further comprising:

a drive shaft frame coupled to the frame; and a drive shaft rotatably coupled to the drive shaft frame, wherein the ring-shaped damper engages with the drive shaft such that rotational movement of the drive shaft axially displaces the ring-shaped damper relative to the drive shaft frame.

19. A system for controlling a ring-shaped damper, comprising:

a frame comprising a rectangular outer diameter, wherein the frame is configured to attach to a ceiling;

the ring-shaped damper, wherein the ring-shaped damper comprises:

a central support ring;

an outer damper wall defining a central flow path through the ring-shaped damper, wherein the outer damper wall has a height X and a diameter D;

a cross-brace support coupled the central support ring and the outer damper wall; and a plate secured to the outer damper wall, wherein the plate is configured to form an air-tight barrier with a portion of the frame extending around a circumference of the ring-shaped damper to block air flow through the central flow path when the ring-shaped damper is in a closed position, and wherein one or more air vents are disposed between the frame and the ring-shaped damper;

a driver coupled to the ring-shaped damper and the frame, wherein the driver is configured to move the ring-shaped damper away from the frame in a first direction and to move the ring-shaped damper toward the frame in a second direction, wherein the driver comprises:

a screw-shaped drive shaft; and a drive shaft frame coupled to the screw-shaped drive shaft and the ring-shaped damper;

an energy harvesting device, wherein the ring-shaped damper is driven by energy harvested from the energy harvesting device;

a room air temperature sensor disposed on the frame or the ring-shaped damper;

a supply air temperature sensor coupled to the frame;

a voltage conditioning and storage unit coupled to the energy harvesting device, wherein the voltage conditioning and storage unit is configured to apply overvoltage and undervoltage protection to a storage capacitor;

a controller coupled to the voltage conditioning and storage unit, wherein the voltage conditioning and storage unit is configured to apply overvoltage protection to the controller; and a motor control coupled to the controller, wherein the motor control is configured to instruct the driver to move the ring-shaped damper to a fully open position if an amount of energy remaining in the storage capacitor reaches a predetermined amount.

* * * * *